US009522805B2

(12) United States Patent
Joyce et al.

(10) Patent No.: US 9,522,805 B2
(45) Date of Patent: Dec. 20, 2016

(54) ELEVATOR SYSTEM FIXTURES AND SERVER FOR CONTROLLING THE FIXTURES

(75) Inventors: Matthew Joyce, Avon, CT (US); Ashley Chapman, Avon, CT (US); Osamu Sakai, Tchiba (JP); Baudelaire St. Louis, Meriden, CT (US); Jannah A. Stanley, Portland, CT (US)

(73) Assignee: Otis Elevator Company, Farmington, CT (US)

( * ) Notice: Subject to any disclaimer, the term of this patent is extended or adjusted under 35 U.S.C. 154(b) by 435 days.

(21) Appl. No.: 14/232,620

(22) PCT Filed: Jul. 15, 2011

(86) PCT No.: PCT/US2011/044143

§ 371 (c)(1), (2), (4) Date: Jan. 14, 2014

(87) PCT Pub. No.: WO2013/012406

PCT Pub. Date: Jan. 24, 2013

(65) Prior Publication Data

US 2014/0151160 A1 Jun. 5, 2014

(51) Int. Cl.
*B66B 1/28* (2006.01)
*B66B 1/34* (2006.01)
(Continued)

(52) U.S. Cl.
CPC ..... *B66B 1/34* (2013.01); *B66B 1/468* (2013.01); *B66B 3/006* (2013.01); *B66B 2201/4615* (2013.01); *B66B 2201/4653* (2013.01)

(58) Field of Classification Search
CPC ..... B66B 1/34; B66B 1/468; B66B 3/006; B66B 2201/4615; B66B 2201/4653
(Continued)

(56) References Cited

U.S. PATENT DOCUMENTS 5,955,710 A * 9/1999 DiFranza ..... B66B 1/34 187/247
6,288,688 B1 * 9/2001 Hughes ..... G06Q 30/02 187/396
(Continued)

FOREIGN PATENT DOCUMENTS

CN 1976855 6/2007
CN 101378982 3/2009
(Continued)

OTHER PUBLICATIONS

Chinese Search Report for Chinese Application No. 201180072271.2, dated Jul. 29, 2014.
(Continued)

*Primary Examiner* — Anthony Salata
(74) *Attorney, Agent, or Firm* — Carlson, Gaskey & Olds

(57) ABSTRACT

An exemplary system for communicating with an elevator passenger includes a plurality of elevator passenger interface devices configured to allow an elevator passenger to indicate at least an elevator service request. The interface devices are configured to communicate at least elevator service information to an elevator passenger. A server communicates with the plurality of interface devices. The server is configured to determine when there is input at any of the interface devices. The server is configured to determine a meaning of such input. The server is also configured to determine output to provide at the corresponding interface device and to communicate the determined output to the corresponding interface device. The determined output is responsive to the determined meaning of the input.

25 Claims, 2 Drawing Sheets

(51) Int. Cl.
*B66B 1/46* (2006.01)
*B66B 3/00* (2006.01)

(58) Field of Classification Search
USPC ..... 187/247, 277, 391, 392, 393, 395, 396; 704/275, 276
See application file for complete search history.

(56) References Cited

U.S. PATENT DOCUMENTS

| | | | | |
|---|---|---|---|---|
| 6,341,668 | B1 * | 1/2002 | Fayette | B66B 3/008 187/247 |
| 6,615,175 | B1 * | 9/2003 | Gazdzinski | B66B 1/34 187/396 |
| 6,801,792 | B1 | 10/2004 | Schuster et al. | |
| 6,868,945 | B2 | 3/2005 | Schuster et al. | |
| 6,962,240 | B2 | 11/2005 | DiFranza et al. | |
| 6,988,071 | B1 | 1/2006 | Gazdzinski | |
| 7,000,735 | B2 * | 2/2006 | Meyer | B66B 3/008 187/247 |
| 7,093,693 | B1 * | 8/2006 | Gazdzinski | B66B 1/468 187/384 |
| 7,319,966 | B2 * | 1/2008 | Friedli | B66B 3/00 187/388 |
| 7,353,915 | B2 | 4/2008 | Zaharia et al. | |
| 7,377,364 | B2 * | 5/2008 | Tyni | B66B 1/468 187/380 |
| 7,419,032 | B2 * | 9/2008 | Yamakawa | B66B 1/34 187/247 |
| 7,711,565 | B1 | 5/2010 | Gazdzinski | |
| 7,793,762 | B2 | 9/2010 | Zaharia et al. | |
| 8,065,155 | B1 * | 11/2011 | Gazdzinski | G06Q 30/0251 369/24.01 |
| 8,151,943 | B2 * | 4/2012 | de Groot | B66B 1/2458 187/382 |
| 8,485,317 | B2 * | 7/2013 | Gerstenkorn | B66B 1/468 187/247 |
| 8,688,664 | B2 * | 4/2014 | Pineau | G06F 17/30371 187/391 |
| 2002/0036122 | A1 | 3/2002 | Fayette et al. | |
| 2002/0130905 | A1 | 9/2002 | Hughes et al. | |
| 2003/0159890 | A1 | 8/2003 | Schuster et al. | |
| 2009/0036111 | A1 | 2/2009 | Danford et al. | |

FOREIGN PATENT DOCUMENTS

| | | | |
|---|---|---|---|
| JP | 8319071 | | 12/1996 |
| JP | 2003212446 | A | 7/2003 |
| JP | 2009143687 | A | 7/2009 |
| JP | 2009223793 | A | 10/2009 |
| WO | 2006041467 | A1 | 5/2006 |
| WO | 2006112812 | A3 | 10/2006 |

OTHER PUBLICATIONS

International Preliminary Report on Patentability for International application No. PCT/US2011/044143 dated Jan. 30, 2014.
International Search Report and Written Opinion of the International Searching Authority for International application No. PCT/US2011/044143 dated Mar. 16, 2012.
Patents Act 1977; Examination Report under Section 18(3) for Application No. GB1402376.6 dated Dec. 21, 2015.

* cited by examiner

ELEVATOR SYSTEM FIXTURES AND SERVER FOR CONTROLLING THE FIXTURES

BACKGROUND

Elevator systems include various types of fixtures for allowing passengers to provide an indication of a desired request for elevator service. Fixtures also provide feedback to the passengers regarding their requests. Traditionally, elevator system fixtures included hall call buttons allowing a passenger to request to be carried up or down from a building level where the passenger accesses the hall call button. Car operating panels have also been traditionally provided within elevator cars allowing passengers to make selections regarding a particular floor to which they desire to be carried.

More recently, destination entry systems have been employed. Such systems include destination entry devices that allow passengers to request to be carried to a particular destination before the passenger enters an elevator car. Destination entry fixtures typically provide a passenger with the ability to enter a request and provide feedback to the passenger to direct them to an appropriate elevator car, for example.

With advances in technology, building owners and elevator passengers have come to expect increasing capabilities from elevator fixtures. Additionally, advances in technology tend to make a particular configuration of an elevator fixture seem outdated within a relatively short period of time. A significant challenge is presented when attempting to update elevator system fixtures because each individual fixture has to have appropriate updates installed. It is not typically economically feasible to simply replace many destination entry type fixtures because each of them has its own processor and other components that render it economically unfeasible to make wholesale replacements of such devices.

SUMMARY

An exemplary system for communicating with an elevator passenger includes a plurality of elevator passenger interface devices configured to allow an elevator passenger to indicate at least an elevator service request. The devices are configured to communicate at least elevator service information to an elevator passenger. A server communicates with the plurality of interface devices. The server is configured to determine when there is input at any of the interface devices. The server is configured to determine a meaning of such input. The server is also configured to determine output to provide at the corresponding interface device and to communicate the determined output to the corresponding interface device. The determined output is responsive to the determined meaning of the input.

An exemplary method of communicating with an elevator passenger includes receiving elevator passenger input at one of a plurality of elevator passenger interface devices. An indication of the received input is communicated to a server that communicates with the plurality of interface devices. The server determines a meaning of the input. The server determines output to provide at the corresponding interface device. The determined output is communicated from the server to the corresponding interface device and the corresponding interface device provides the determined output.

The various features and advantages of the disclosed example will become apparent to those skilled in the art from the following detailed description. The drawings that accompany the detailed description can be briefly described as follows.

DETAILED DESCRIPTION

Figure 1:
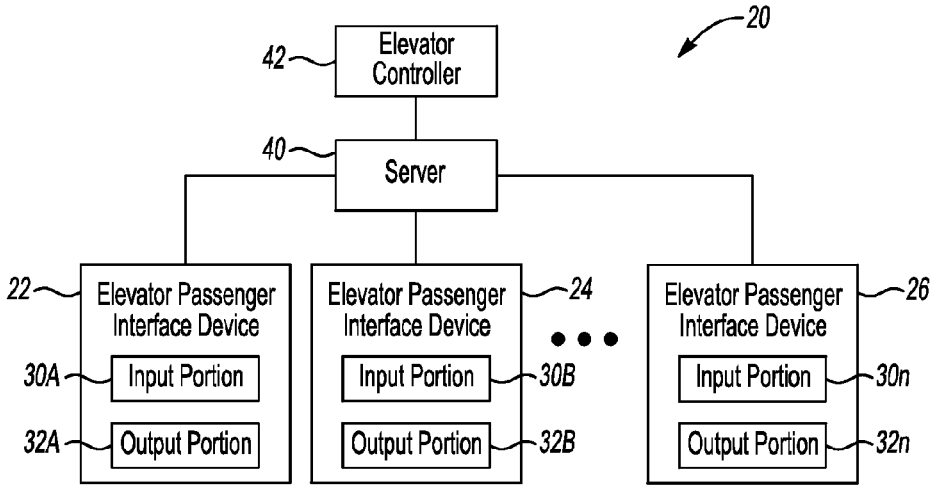
FIG. 1 schematically illustrates selected portions of an elevator system designed according to an embodiment of this invention.

FIG. 1 schematically illustrates selected portions of an elevator system 20 that is useful for communicating with elevator passengers. A plurality of elevator passenger interface devices 22, 24 and 26 are configured to allow an elevator passenger to request elevator service and to provide information to such a passenger regarding such a request. Although three interface devices are illustrated in FIG. 1, the system 20 may include many more such devices. In some examples, the interface devices comprise destination entry devices that allow a passenger to provide an indication of a desired destination before the passenger enters an elevator car. In such examples, the interface devices are located outside of an elevator car. In other examples, the interface devices are located inside of an elevator car. Given this description, those skilled in the art will realize how to implement the features of the disclosed example with a variety of elevator system fixtures (i.e., passenger interface devices) to meet the needs of their particular situation.

Each of the illustrated interface devices includes an input portion 30 and an output portion 32. Designations such as a, b and n are associated with the input portions and output portions of the different interface devices to distinguish among them. The input portions 30 allow a passenger to provide input that indicates a passenger's desired interaction with the elevator system such as requesting elevator service. The passenger input may be manually entered (e.g., using a keypad or touch screen), read from a credential holder or obtained through biometric scanning, for example. Other requests may be made by a passenger such as requesting information that may be available through the interface device. The output portions 32 provide information to passengers regarding their entered request. The information provided to passengers may be visible, audible or a combination of these.

Although input portions 30 and output portions 32 are schematically shown separately in FIG. 1, it is possible that the same portion of an interface device operates as the input portion and the output portion. For example, a touch screen may function as the input portion 30 and the output portion 32 because the touch screen is that which a passenger touches to request elevator service and that which the passenger views to receive information regarding the request.

The example of FIG. 1 includes a server 40 that communicates with the plurality of interface devices 22, 24 and 26. The server 40 in some examples is capable of communicating with more than 100 passenger interface devices. In some examples, the server 40 communicates with hundreds of interface devices. The server 40 is responsible for processing all of the input and output at each of the interface devices. The interface devices, themselves, are not required to have sufficient processing capacity to operate independent of the server 40. The illustrated example, therefore, centralizes all of the processing required for handling passenger input at any of the interface devices and providing passenger information at any of the interface devices at the location of the server 40.

In some examples, the server 40 is dedicated to processing all information associated with the interface devices within a single building. In some examples, the server 40 processes information regarding interface devices in more than one building.

The communications between the server 40 and the interface devices schematically shown in FIG. 1 may occur over a local area network, an Ethernet connection, wireless links or other high speed data communication networks. The server 40 is responsible for managing the operation of each of the interface devices and, therefore, it is desirable to have high speed communications with sufficient bandwidth to provide an appropriate response to passenger input at a corresponding interface device on a perceived, immediate basis. There are various known high speed communication networks that allow for sufficient communication between the server 40 and the interface devices 22, 24 and 26 to realize results that will satisfy elevator passenger or building owner requirements.

The server 40 is configured to determine whether there is any input at any one of the interface devices 22, 24 or 26. When there is input, the interface device provides an indication of that input to the server 40 so that the server is able to determine the meaning of the input. In this example there is no processing at the interface device to determine a meaning of passenger input. For example, if the interface device provides a series of selectors (e.g., keypad buttons or button representations on a touch screen), the interface device does not process information regarding a passenger selection of such a selector but, rather, passes information to the server 40 regarding such input. The server 40 then makes a determination regarding the meaning of that input (e.g., the passenger has indicated a desire to be carried to a particular floor).

In the case of requests for elevator service, the server 40 provides information to an elevator controller 42 that makes appropriate determinations such as assigning a car to service the passenger's request in a known manner. The elevator controller 42 provides information to the server 40 regarding how the associated elevator system will be operating to service that passenger request. For example, the elevator controller 42 provides information to the server 40 regarding the elevator car that has been assigned to that request. The server 40 then determines an appropriate output to provide at the corresponding interface device at which the passenger input was initially received. Providing that output to the passenger interface device allows that device to then communicate the output to the passenger in the desired fashion. The output may be a visible indication of the assigned car, an audible indication of the assigned car or both, for example.

In one example, a plurality of files are prestored having a set of predetermined outputs that are accessible by the server 40. When visible output is desired, the prestored files have a selected format that is compatible with the interface device. The prestored files in one example comprise JPEG format files that contain display information to be displayed on the output portion 32 of the corresponding interface device. Other file formats are useful for visual information including the known .png and .bmp formats. Utilizing prestored image or video files facilitates faster response by eliminating a requirement for the server 40 to generate a display based upon the passenger request and the manner in which the elevator system will respond to that request. Additionally, using prestored files allows for providing the output at the interface device without requiring any processing at the interface device to generate the display other than to merely display what is contained in the file.

Many systems that communicate to an interface device that has its own processor send pixel data to the processor and then rely upon the processor to then generate an appropriate display content for display at an interface device. Using prestored files allows for minimizing the data transmission requirements and in some examples reduces the data transmission requirements by as much as 75%. Accordingly, such examples provide a significant advance in the ability to control passenger interface devices within an elevator system. In some examples, serial data transport protocols or Ethernet protocols are useful for communicating such information to the interface devices.

When the output is to include audible content, the prestored files include audio files such as those having a MP2, MP3 or .wav format. Using such prestored files allows for the server 40 to determine which file is appropriate for a given circumstance, to provide that file to the corresponding interface device and allows the interface device to readily play back the audio content of that file without requiring any processing at the interface device for generating such content.

Utilizing prestored output files on the passenger interface device in this example also minimizes the data transfer required between the server 40 and the interface devices 26. This allows a single server 40 to be able to handle communications with a large number of interface devices and to communicate information to the interface devices to provide a response to passenger input in an extremely rapid fashion.

In other examples, the output is generated by the server 40 in real time rather that being a prestored video, image or audio file. Even with such examples, the processing burden need not be placed on the interface device because the server 40 is responsible for providing the content to be provided to the passenger.

Figure 2:
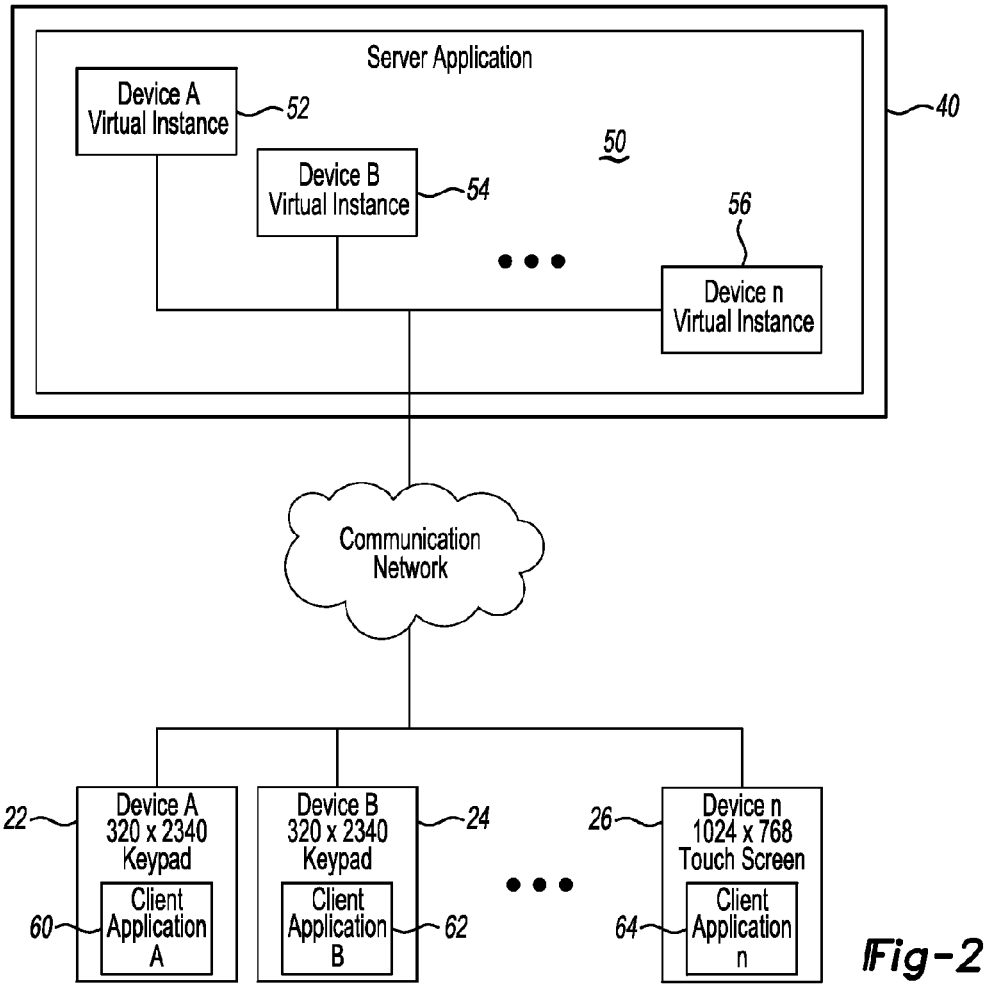
FIG. 2 schematically illustrates selected features of the example of FIG. 1.

In some examples, the server 40 allows a building owner or occupant to customize the display. This provides an ability to change the appearance of the interface devices in an economical manner that does not require installing new hardware or modifying existing hardware. The example arrangement allows for customizing the appearance of the interface without changing the software of the server 40 or the display device. By providing a new image file, the appearance can be changed. This overcomes the traditional limitations on the design and passenger perception of elevator systems. Elevator fixtures typically have been offered with limited customization and do not allow architects and building owners to achieve a desired look. With the disclosed example approach of controlling the appearance of passenger interface devices, however, the designer and building owner have significant freedom to realize a variety of looks and to change them over time according to their desires or needs. For example, the output may be customized to present different looks for different building tenants or for different passengers FIG. 2 schematically illustrates an example in which the server 40 includes a server application 50 comprising software, for example. The server application 50 includes a plurality of virtual instances corresponding to the plurality of passenger interface devices that are controlled by the server 40. In this example, a virtual instance 52 of the interface device 22 is maintained by the server application 50. The virtual instance 52 mimics everything that occurs at the interface device 22 so that the server application 50 and the server 40 is continuously aware of the status of the interface device 22. For example, whenever input is received at the interface device 22, a corresponding indication of that input is provided at the virtual instance 52.

Virtual instances 54 and 56 are provided that correspond to the interface devices 24 and 26, respectively. By maintaining a plurality of virtual instances corresponding to the interface devices controlled by the server 40 allows for making any changes such as updates or upgrades to the functionality of the interface devices by updating the server application 50 without requiring any particular updates to any of the hardware, software or firmware of the interface devices, themselves. In this example, all of the execution of the elevator specific software functions occur at the virtual instances 52, 54 and 56 of the server application 50. Accordingly, changing the manner in which information is processed from or provided to elevator passengers is accomplished by updating the server application 50 without requiring a change to the physical interface devices. This allows for updating a mass number of interface devices in an efficient and reliable manner.

In some examples, the server 40 is responsible for controlling interface devices of different types. Some may have a manual keypad as part of the input portion. Others may have a touch screen as part of the input portion. Some may have display screens while others only have a speaker for providing audible output. Each virtual instance of the server application 50 is customized to correspond to the interface device that the virtual instance represents. The server application 50 is configured to handle a variety of interface device types.

Figure 3:
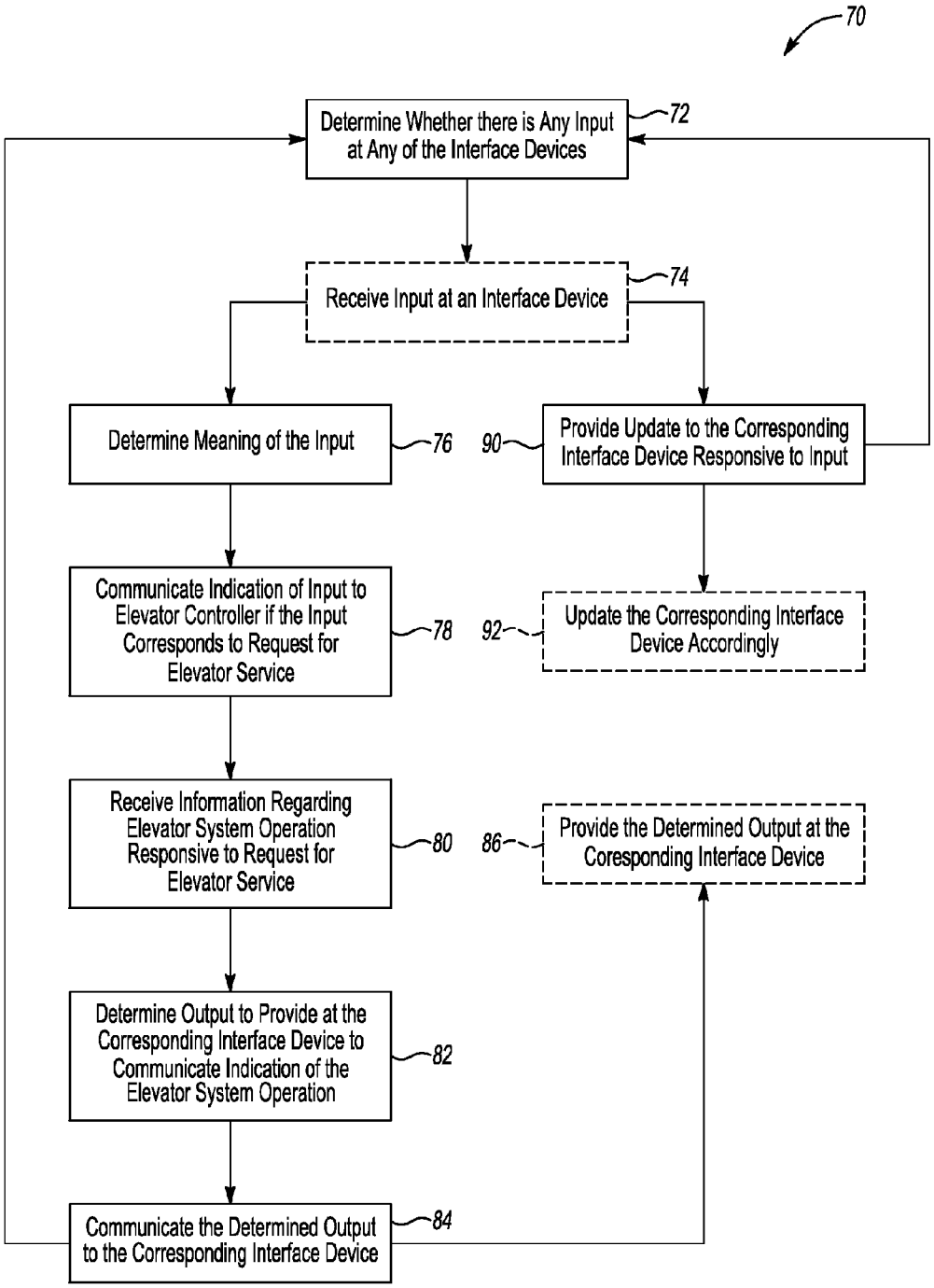
FIG. 3 is a flowchart diagram summarizing an example approach.

FIG. 3 includes a flowchart diagram 70 that summarizes an example approach for communicating with elevator passengers using interface devices that are controlled by the server 40. In FIG. 3, the boxes in solid lines indicate functions performed by the server 40 while boxes shown with dashed lines indicate functions at the passenger interface devices.

The example flowchart 70 includes a determination at 72 whether there is any input at any of the interface devices. This is accomplished by the server 40 monitoring any changes at any of the virtual instances, for example, in the server application 50. At 74, input is received at an interface device. An indication of that input is communicated to the server 40, which determines a meaning of the input at 76. Assuming that input is a request for elevator service, an indication of that input is communicated to the elevator controller 42 as shown at 78. At 80, the server 40 receives information regarding elevator system operation responsive to the request for elevator service. At 82, the server 40 determines the output to provide at the corresponding interface device so that the passenger receives some indication of the elevator system operation regarding the request for service. For example, the determined output comprises an indication of which elevator car the passenger should enter to be carried to the intended destination.

At 84, the output determined by the server 40, which may comprise a prestored file as described above, is communicated to the corresponding interface device. An appropriate output is provided at the corresponding interface device at 86 in FIG. 3.

In most instances, the communication at 84 will be to the interface device at which the passenger input was received. It is possible, however, to provide an output at a separate location such as, for example, where a passenger's request is received at a building entry point and a display located in another portion of a building lobby provides guidance to the passenger regarding the elevator car that will service that request. In the latter case, the interface device has some components at one location and at least one other at another location.

Another feature of the illustrated example is shown at 90 where the server provides an update to the corresponding interface device responsive to the input. This is useful for controlling the interface device so that a passenger has the experience of understanding that their input was received by the system. For example, when an individual presses a button on a manual keypad, the update may be audible feedback such as a clicking noise or a chime that communicates to the individual that the button was appropriately pressed.

If the interface includes a touch screen, for example, the look of the display is updated corresponding to the input. For example, the server 40 determines which portion of the touch screen has been contacted through the virtual instance corresponding to the interface device currently in use. Assuming that portion of the touch screen shows a floor selector button, the server 40 determines how the display should appear to indicate that portion of the touch screen has been appropriately contacted by the individual. For example, the update provided at 90 corresponds to a different appearance of the display screen that shows the button that has been contacted as if it were pressed inward relative to the screen. This provides immediate feedback to the individual that they have successfully communicated their intentions to the elevator system.

Of course, additional updates may be provided such as combined visual and audible effects. The server 40 is the portion of the system that makes the determinations regarding how that update will be provided and communicates appropriate information to the corresponding interface device so that the interface device can update that which is shown or played for the passenger responsive to the input on an effectively immediate basis. In one example, the response time at which the corresponding interface device is updated at 92 occurs within 100 milliseconds. Such a rapid response time is possible because the server 40 uses the virtual instance of the server application for determining what has occurred at the interface device and uses pre-cached or prestored file information as the update that is provided to the interface device.

As can be appreciated from the preceding description, a single server device can be used for controlling a plurality of passenger interface devices in an elevator system for managing communications with elevator passengers. The disclosed example is not limited to any type of passenger interface device. Moreover, the disclosed example allows for providing any updates or changes to the manner in which the interface devices interact with passengers without necessarily requiring any change to the interface devices, themselves.

Additionally, with the disclosed arrangement it is much easier to add passenger interface devices to one or more elevator systems by creating an application for the new device that can interface to the server. This allows for multiple device platforms to be supported using one server platform. For example, an appropriately configured mobile device may have an application that can interface with the server 40 and the server 40 has a corresponding virtual instance for such a device to allow that device to function as the passenger interface device.

The disclosed examples have various features that may be interchanged to realize even more example configurations. In other words, one or more features of one example may be utilized in combination with one or more features of another disclosed example.

The disclosed examples provide various advantages including cost reduction through vendor competition and reduced device requirements, simplified customization of interface devices by installers and customers, simplicity of new device integration features and the ability to support multiple device platforms.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A system for communicating with an elevator passenger, comprising:

a plurality of elevator system passenger interface device fixtures configured to allow an elevator passenger to provide input to indicate at least an elevator service request and to communicate at least elevator service information to the elevator passenger; and a server that centralizes the processing required for handling passenger input for an elevator call at any of the interface device fixtures and providing passenger information at any of the interface device fixtures, the server being configured to communicate with the plurality of interface device fixtures, the server being configured to determine when there is input at any of the interface device fixtures, the server being configured to determine a meaning of the input, the server being configured to determine output to provide at the corresponding interface device fixture and to communicate the determined output to the corresponding interface device fixture, the determined output being responsive to the determined meaning of the input.

2. The system of claim 1, wherein the server is configured to maintain a virtual instance of each of the interface device fixtures;

the virtual instance of each interface device fixture is configured to provide an indication of any input at the corresponding interface device fixture; and the server determines the input at the corresponding interface device fixture from the indication provided by the corresponding virtual instance.

3. The system of claim 2, wherein each virtual instance indicates a current state of the corresponding interface device fixture.

4. The system of claim 1, wherein each interface device fixture comprises a device application that is configured to provide an indication to the server responsive to any input at the corresponding interface device fixture, the indication providing information to the server to allow the server to determine the meaning of the input; and control output provided by the interface device fixture responsive to the determined output from the server.

5. The system of claim 1, wherein the server is configured to determine a type of the input at the corresponding interface device fixture and to responsively provide an update to the corresponding interface device fixture which responsively provides an indication at the interface device fixture regarding the input.

6. The system of claim 5, wherein the input comprises contact with an input portion of the corresponding interface device fixture and the update comprises at least one of visible output or audible output corresponding to the contact.

7. The system of claim 6, wherein the input portion of the corresponding interface device fixture comprises a touch screen, the input comprises contact with an area of the touch screen and the update comprises a change in an appearance of at least the area of the touch screen.

8. The system of claim 7, wherein the update comprises audible output corresponding to the contact with the area of the touch screen.

9. The system of claim 1, comprising a plurality of files having predetermined content, the files being accessible by the server and wherein the server selects one of the files as the determined output responsive to the determined meaning of the input.

10. The system of claim 9, wherein the determined output comprises visual content and the selected one of the files comprises a JPEG format file to be displayed on an output portion of the corresponding interface device fixture.

11. The system of claim 9, wherein the determined output comprises audible content and the selected one of the files comprises a .wav format file to be played at an output portion of the corresponding interface device fixture.

12. The system of claim 1, comprising an elevator controller and wherein the server is configured to provide an indication of the input to the elevator controller when the determined meaning of the input corresponds to a passenger request for elevator service and the server is configured to receive an indication from the elevator controller regarding corresponding elevator system operation, the determined output provided to the corresponding interface device fixture providing information regarding the corresponding elevator system operation.

13. The system of claim 1, wherein the interface device fixtures each comprise a destination entry device configured to allow an elevator passenger to indicate a desired destination prior to the passenger entering an elevator car.

14. A method of communicating with an elevator passenger, comprising the steps of:

receiving elevator passenger input at one of a plurality of elevator system passenger interface device fixtures;

communicating an indication of the received input to a server that communicates with the plurality of interface device fixtures and centralizes the processing required for handling passenger input for an elevator call at a of the interface device fixtures and providing passenger information at any of the interface device fixtures;

determining a meaning of the input at the server;

determining, at the server, output to provide at the corresponding interface device the determined output being responsive to the determined meaning of the input;

communicating the determined output from the server to the corresponding interface device fixture; and providing the determined output at the interface device fixture for the passenger.

15. The method of claim 14, comprising maintaining a virtual instance of each of the interface device fixtures at the server;

using the virtual instance of the corresponding interface device fixture for providing an indication of the received input to the server; and determining the meaning of the received input from the indication provided by the virtual Instance of the corresponding interface device fixture.

16. The method of claim 15, comprising providing an indication of a current state of the corresponding interface device fixture from the virtual instance of the corresponding interface device fixture to the server.

17. The method of claim 14, comprising determining a type of the input at the corresponding interface device fixture;

responsively providing an update from the server to the corresponding interface device fixture; and providing an indication at the interface device fixture regarding the input responsive to the provided update.

18. The method of claim 17, wherein the input comprises contact with an input portion of the corresponding interface device fixture and the update comprises at least one of visible output or audible output corresponding to the contact.

19. The method of claim 18, wherein the input portion of the corresponding interface device fixture comprises a touch screen, the input comprises contact with an area of the touch screen and the update comprises a change in an appearance of at least the area of the touch screen.

20. The method of claim 19, wherein the update comprises audible output corresponding to the contact with the area of the touch screen.

21. The method of claim 14, comprising selecting, by the server, one of a plurality of files having predetermined content for the determined output responsive to the determined meaning of the input.

22. The method of claim 21, wherein the determined output comprises visual content and the selected one of the flies comprises a JPEG format file and comprising displaying content of the JPEG format file on the corresponding interface device fixture.

23. The method of claim 21, wherein the determined output comprises audible content and the selected one of the files comprises a .wav format file and comprising playing content of the .wav format file at the corresponding interface device fixture.

24. The method of claim 14, comprising providing an indication of the input to an elevator controller when the determined meaning of the input corresponds to a passenger request for elevator service;

receiving an indication at the server from the elevator controller regarding corresponding elevator system operation; and providing the determined output to the corresponding interface device fixture for providing information regarding the corresponding elevator system operation.

25. The method of claim 14 wherein the interface device fixtures each comprise a destination entry device configured to allow an elevator passenger to indicate a desired destination prior to the passenger entering an elevator car.

* * * * *